United States Patent [19]

Barakauskas

[11] 4,185,538

[45] Jan. 29, 1980

[54] SIMPLIFIED AIR SYSTEM FOR UNDERWATER ROCKET LAUNCHING

[75] Inventor: Edward J. Barakauskas, Saratoga, Calif.

[73] Assignee: The United States of America as represented by the Secretary of the Navy, Washington, D.C.

[21] Appl. No.: 53,021

[22] Filed: Aug. 30, 1960

[51] Int. Cl.[2] ..... F41F 3/04

[52] U.S. Cl. ..... 89/1.810; 89/1.818

[58] Field of Search ..... 89/5, 1.3, 1.7 B, 1, 89/1.7, 1.810, 1.818; 114/238, 17; 124/11, 13; 102/49

[56] References Cited

U.S. PATENT DOCUMENTS

| | | | |
|---|---|---|---|
| 2,349,009 | 5/1944 | Schwab | 114/320 |
| 2,383,053 | 8/1945 | Fanger et al. | 89/1 F X |
| 2,960,977 | 11/1960 | Moorhead | 124/75 X |
| 2,989,899 | 6/1961 | Siegel et al. | 89/1.810 |

*Primary Examiner*—David H. Brown

*Attorney, Agent, or Firm*—R. S. Sciascia; Sol Sheinbein

EXEMPLARY CLAIM

1. A missile launching system comprising a launching tube including a first chamber and a second chamber containing the missile to be launched, a source of gas compressed to a pressure substantially in excess of the pressure of the environment into which the missile is to be launched, and valve means for admitting said compressed gas into said first chamber a bulkhead between said first and second chambers, said bulkhead being formed with a plurality of openings, a plate formed with similar openings mounted for rotation on said bulkhead, and means for rotating said plate to gradually align the openings of the plate with the openings of the bulkhead during the launching movement of the missile in the launching tube to continually increase the flow of compressed gas from the first chamber to the second chamber causing a rapid rise of pressure in said first chamber and resultant constantly increasing pressures communicated to said second chamber via said adjustable orifice for lauching said missile.

2 Claims, 3 Drawing Figures

SIMPLIFIED AIR SYSTEM FOR UNDERWATER ROCKET LAUNCHING

This invention relates to a system for projectile ejection and more specifically to a system for ejecting a missile from its launching tube.

The ejection of a missile from its container or launching device has presented an increasingly serious problem as advances in the missile art have been made technologically feasible the firing of these devices from movable platforms or in unusual and adverse environments.

Formerly, when it was desired to fire a missile, the conventional procedure was to balance the device in an upright position on a flat firing pad constructed so as to withstand the considerable heat and pressure which inevitably attend a missile launching. Now that weapons of this nature have been made relatively reliable it is desired to launch the missile from a mobile platform which of necessity cannot be constructed in the fashion of massive reinforced concrete slabs. The extreme conditions encountered in modern warfare even comprehend the launching of a missile from the interior of a submerged submarine in such a manner that the missile will be ejected from the submarine, pass through the water, and then be propelled so as to follow a ballistic trajectory to a target some thousands of miles away.

It will be appreciated that structural limitations of the vessel will not permit the ignition of the rocket propellant while the missile is within the submarine and therefore it is necessary that a system be provided to eject the missile under closely controlled conditions so that the portion of its travel prior to ignition of the propellant will not have an adverse effect on its subsequent performance.

The requirements of such a system include a positive force with the capability of ejecting a large missile that may weigh many thousands of pounds and a method of controlling the aforesaid force so that the missile attains a maximum terminal velocity, relative to the launching tube, while at the same time the sensitive stress limits of the missile components are not exceeded.

One method suggested for accomplishing the desired result is to eject the missile from the container or launching tube by the application of compressed air from a storage tank. It is immediately obvious that as the missile leaves the tube a constantly expanding volume results which has a tendency to reduce the air pressure in the expanding chamber. At the same time the pressure in the air tank, having been built up to some initial value, is decreasing, which tends to reduce the volume of air flowing into the launching tube. The application of air pressure must also be limited so that the maximum acceleration the missile can withstand, without damage to the delicate control and guidance mechanism contained therein, will not be exceeded. Ideally, the flow of air should be constantly increasing so that a continuous uniform force will be exerted on the missile during the time that its velocity is increasing from zero to its terminal velocity on tube exit.

One technique for controlling the force applied to a missile has been to provide a complicated programming system for the control of power driven valves which permit the flow of varying quantities of air to the launcher tube in such a manner that a reasonable terminal velocity will be achieved, while at the same time the acceleration forces will be maintained consistent with the system limits.

Accordingly, it is an object of this invention to provide an improved projectile ejection system.

It is a further object to provide a missile launching device suitable for operation above or below the surface of a body of water.

It is another object to provide a projectile ejection system for use in a submarine or undersea vessel.

Still another object of the present invention is to provide a system that will eject a missile with a predetermined maximum acceleration force.

Still another object resides in the provision of a missile ejection system with increased reliability.

It is yet another object to provide an air powered ejection system for use in submerged vessels.

An additional object is to provide a missile ejection system that will provide essentially the same ejection velocity when used above or below the surface of a body of water.

Other objects and many of the attendant advantages of this invention will be readily appreciated as the same becomes better understood by reference to the following detailed description when considered in connection with the accompanying drawings wherein.

Figure 1:
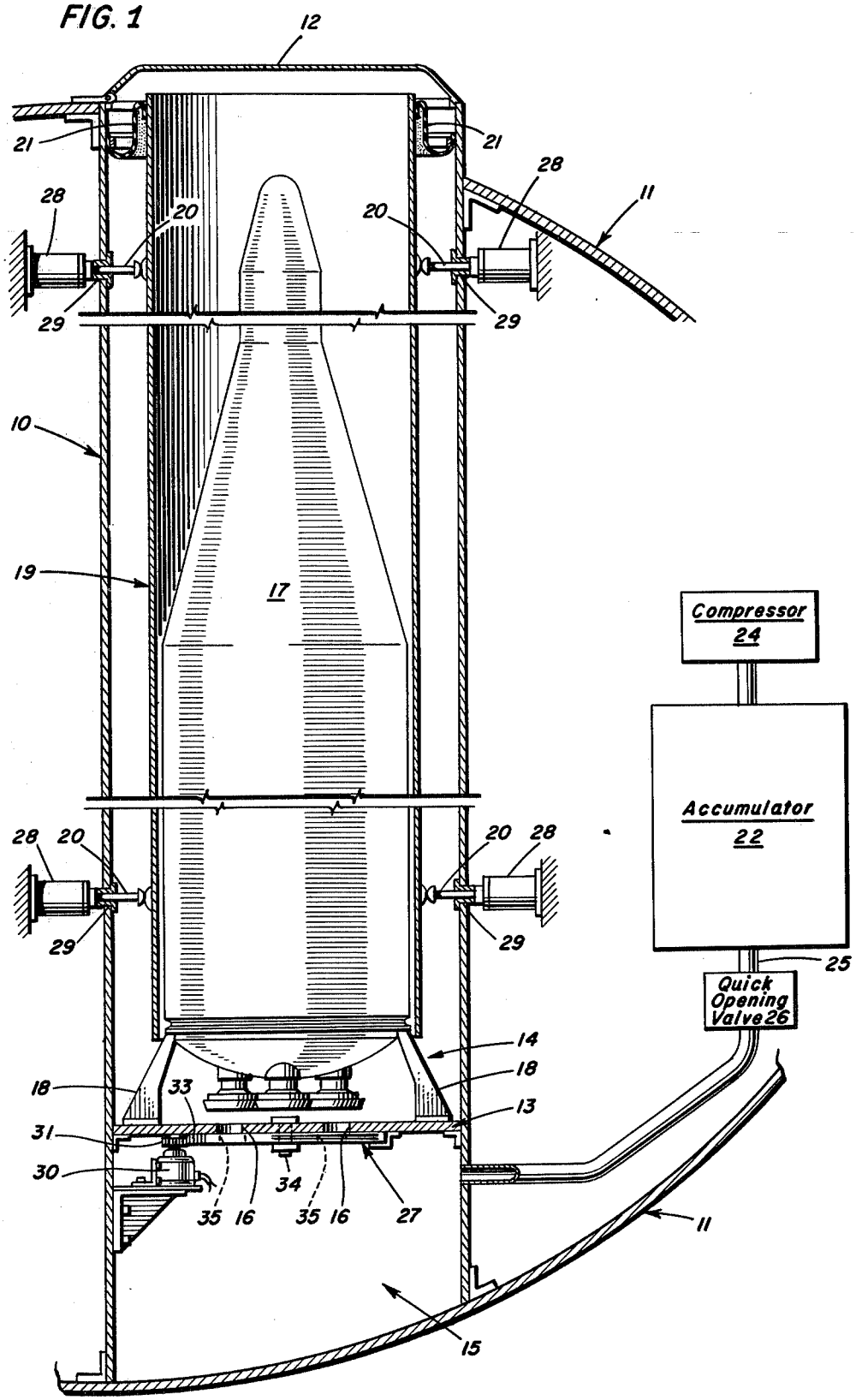
FIG. 1 is a central vertical section of the ejection tue with a missile contained therein and shown in side elevation.

Referring now to the particular embodiment disclosed in FIG. 1; a vertical missile launching tube is shown at 10 which may be supported by any convenient means, illustrated here as the hull of a submarine 11. The launcher tube 10 extends through the upper portion of the hull of the vessel so that a missile may be ejected in a vertically upward direction. A cover 12 is removably attached to the upper end of tube 10 in order to prevent the entry of sea water into tube 10 prior to missile ejection when submerged. Any of a number of well known means may be utilized to open the cover 12 when it is desired to launch a missile.

The launcher tube 10 is horizontally divided into chambers 14 and 15 by bulkhead 13 which contains adjustable orifices 16 connecting the aforesaid chambers. A rotatable plate 27 is provided to adjust the diameter of orifices 16 which will be explained later. The plate 27 may be rotatably attached to bulkhead 13 by any of a number of well known means. The upper chamber is adapted to contain a missile 17 which is supported by mounting blocks 18 carried on bulkhead 13. The missile is held in an upright position by an adjustable inner tube 19 which is mounted approximately coaxially within the launcher tube by adjustable support pistons 20 extending from actuating cylinders 28 through the wall of the launcher tube 10. Gaskets 29, of any suitable material, may be provided to prevent leakage of water through the openings for pistons 20. The inner tube 19 and the associated adjustable support pistons may be utilized to make final adjustments in the attitude of the missile just prior to launching. A flexible diaphram 21 is provided to seal the space between the launcher tube 10 and the inner tube 19. The missile slidably fits in the said inner tube so as to form a loose seal and enable air pressure to be built up in the upper chamber 14 of the launching tube 10. The lower chamber 15 is used to provide an air space for reasons to be explained hereinafter.

Figure 2:
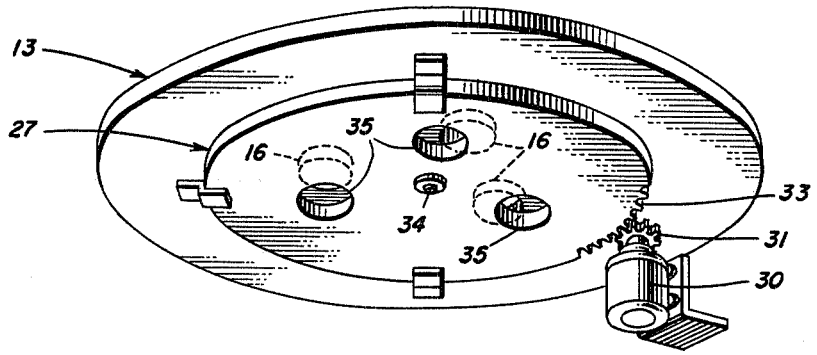
FIG. 2 is a detail perspective of the orifice control mechanism.

It will be appreciated by one skilled in the art that the area of the orifices in bulkhead 13 separating the upper and lower chambers, may be adjusted by any of a number of well-known means. One such method for accomplishing the desired result is disclosed in FIG. 2 wherein there is shown a perspective view of the underside of bulkhead 13 containing three symmetrically positioned circular orifices 16, equi-distant therein from the center of the bulkhead. The circular plate 27 of lesser diameter than bulkhead 13 is rotatably mounted by pin 34, which is attached to the center of bulkhead 13, in such a manner that the plate may be rotated coaxially in relation to the bulkhead. Symmetrical holes 35 are so positioned in plate 27 that when this plate is rotated about the pivotal axis 34 the apertures 35 in the rotating plate will be placed in alignment with the orifices 16 in bulkhead 13. By the rotation of plate 32 the area of the three orifices 16 may be increased or decreased depending upon the degree in which the orifices 16 in bulkhead 13 are in alignment with the apertures 35 in plate 32. A sector of the periphery of plate 27 is provided with geared teeth 33 so that electric motor 30, which includes gear 31 on its drive shaft and is mounted on the lower side of bulkhead 13, controls rotation of the aforesaid plate 32. Thus, the motor 30, which may be of any nature, such as a selsyn or servo motor, controls the position of the rotatable plate 27 and thereby controls the area of the orifices 16 which it will be desired to adjust; depending on whether a missile is launched from above or below the surface of the water.

A compressed air system is provided which includes an accumulator 22 which may be charged through pipe 23 by compressor 24 prior to the discharge of a missile and preferably when the submarine is on the surface. An outlet pipe 25 is provided with a quick opening valve 26 which connects the accumulator 22 through said valve to the lower chamber 15 of launcher tube 10. It will be understood that any suitable fluid, whether it be gas or liquid, may be used in the system. Although the fluid is described herein as compressed air, the invention is not intended to be limited to the use of this type fluid.

Figure 3:
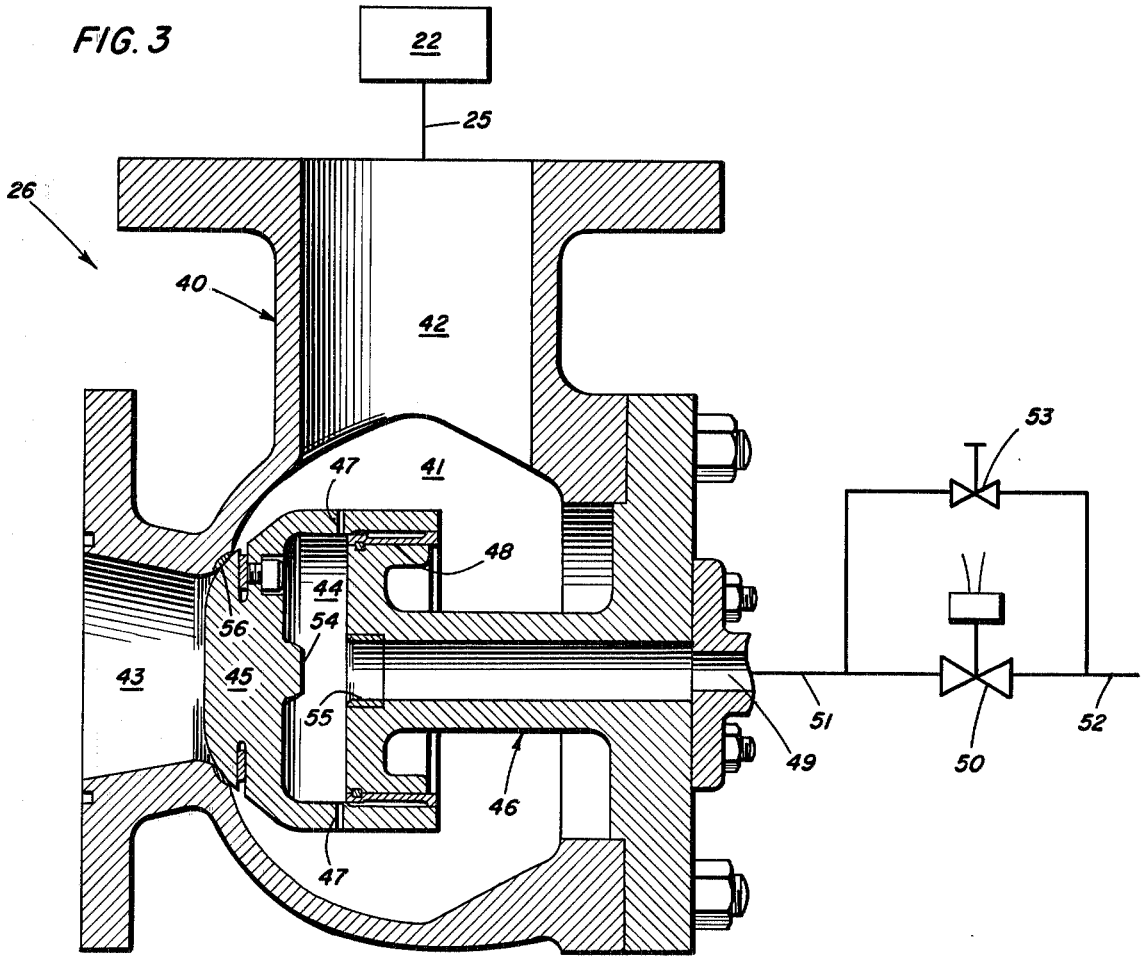
FIG. 3 is a sectional view of one type of quick opening valve.

One of many possible embodiments of quick opening valve 26 is disclosed in FIG. 3 wherein valve body 40 contains an interior chamber 41 provided with an inlet opening 42 and an outlet opening 43. Contained within the valve body is balancing cylinder 44 formed by the skirt of the valve piece 45 and by the fixed balancing piston 46. The balancing cylinder is connected to the interior chamber 41 through two small apertures 47. The valve piece is slidably mounted on flange 48 extending from the fixed balancing piston 46. An axially positioned opening extends from balancing cylinder 44 through the fixed balancing piston 46 to the exterior of the valve assembly 40. A quick opening pilot valve 50, which may be of the explosive type, is connected through pipe 51 to an exterior opening 49 of the fixed balancing piston. The other side of the quick opening pilot valve is connected through pipe 52 to an air source of approximately 100 p.s.i.a. A second pilot valve 53, which may be manually operated, is connected so as to by-pass the explosive pilot valve 50. The interior of valve piece 45 is provided with a plunger 54 mounted coaxially with the said valve piece. The interior end of the hole bored through balancing piston 46 is provided with a bushing 55 adapted to receive plunger 54 when valve piece 45 moves to the open position. A flexible lip 56 is provided around the interior of outlet opening 43 to assure uniform seating of valve piece 45 when in the closed position.

In operation the valve 26 is normally in the closed position with the valve piece 45 seated against the outlet opening 43. The explosive pilot valve 50 and the auxiliary hand-operated valve 53 are in the closed position completely blocking the pipe 51. Inlet opening 42 is connected to an accumulator 22, through pipe 25, and pressurized to 4,000 p.s.i.a. The balancing cylinder 44, the interior hole extending through the fixed balancing piston 46 and the pipe 51 up to the explosive pilot valve 50 are also pressurized to the accumulator pressure through the small apertures 47 in the skirt of valve piece 45. When pilot valve 50 is actuated the balancing cylinder is connected to the 100 p.s.i.a. air source which causes the high pressure therein to immediately bleed off. The small aperture 47 are sized so that it will take an appreciable period of time for the air pressure in the balancing cylinder to build back up to 4,000 lbs. Before this can happen, the valve piece 45 moves toward the fixed balancing piston in a rapid manner under the force of the accumulator air pressure. As the valve piece moves toward the open position, the small apertures 47 in the skirts thereof are blocked by flange 48 on the fixed balancing piston thus cutting off the high pressure air supply to the balancing cylinder. As the valve piece moves further toward the open position, the plunger 54 fits into bushing 55 thereby blocking the only remaining exit for the air trapped in balancing cylinder 44, and forming an air cushion to prevent valve piece 45 from slamming against the fixed balancing piston. The valve will remain in the open position as long as the accumulator 22 is charged to more than 100 p.s.i.a.; however, when the pressure falls below this, the 100 p.s.i.a. source of air pressure connected to pipe 52 provides sufficient pressure to force the valve piece 45 to move to the closed position and seal against flexible lip 56. This automatic closing feature is necessary to prevent the entry of seawater, through outlet opening 43, into the accumulator chamber after a missile has been launched. The manually operated pilot valve 53, which by-passes the explosive pilot valve 50, is used to operate the valve piece 45 to the closed position prior to the normal cycle of operation.

Having described the construction of the ejection system its operation will now be explained in detail.

When it is desired to eject a missile from a submerged submarine, the interior of the launching tube 10, including chambers 14 and 15, is pressurized to the exterior sea pressure by accumulator 22 or by means of a separate air system (not shown) and the cover 12 is removed. After the launching tube is opened, quick opening valve 26 is actuated to the open position releasing air from accumulator 22 through pipe 25 to lower chamber 15 of launcher tube 10. Initially chambers 14 and 15 are at sea pressure while the pressure in the accumulator is much higher. Air will rush into chamber 15 rapidly increasing the pressure therein. The valve 26 constitutes an orifice through which the air in accumulator 22 must pass in order to pressurize chamber 15. The size of said orifice, which is set forth hereinafter, is selected so that a few tenths of a second are required to pressurize chamber 15. This pressure buildup will in turn pressurize chamber 14 through orifices 16. The rate of flow of the air mass through orifices 16 will be directly proportional to the pressure in chamber 15, for flow in the sonic range.

Thus it may be seen that initially when the pressure in chamber 15 is low, the mass of air flowing through orifices 16 is small but as the pressure in chamber 15 increases the mass rate of air flowing through orifices 16 into chamber 14 will increase. This is the desired condition because the effective volume of chamber 14 is increasing as the missile moves upwardly and out of the launching tube. The rate of flow of air from chamber 15 through orifices 16 into chamber 14 will continue to increase until the volume of air leaving chamber 15 is greater than the volume of air entering from accumulator 22. Until this condition is reached, the system will display the characteristic of a continuously increasing source of air without the use of any control mechanism after the operation is initiated.

A direct connection of accumulator 22 to chamber 14 has the disadvantage of creating an exponential decrease in flow rate from an initial maximum to an ineffective minimum at a time when it would be desirable for the flow rate to be continually increasing. Additionally a high initial impulse force would be applied to the missile which may exceed its structural limitations.

The diameter of the inner tube 19 is selected such that the missile will just slide down inside the tube, forming a fit similar to a piston in a cylinder. It has been found that for a missile several feet in diameter, the leakage space between the sheel of the missile and the inner tube can be held to less than 15 square inches.

The operation of the ejection system has been described for submerged conditions; however, the invention is not so limited. The launching operation can be conducted on the surface as well as from underwater. When operating on the surface, the step of pressurizing the launching tube is, of course, omitted. It has been found that to maintain the terminal velocity essentially constant for both submerged and surfaced launchings it is desirable to adjust the diameter of orifices 16 so that they will be relatively larger for submerged operation and relatively smaller for surface operation.

It has been discovered that one set of parameters which will result in efficient operation of this system is for the quick opening valve to have an area of 20 square inches and the adjustable orifice 16 to have an area of 40 square inches when on the surface, and an area of 60 square inches when submerged to a depth of 100 feet. These values are based on an accumulator with a capacity of 40 cubic feet, pressurized to 4015 p.s.i.a., chamber 15 containing a volume of 96 cubic feet and chamber 14 containing 479 cubic feet. With these values a missile velocity of 95 feet per second can be obtained on the surface and 89 feet per second when submerged to a depth of 100 feet with a missile weight of approximately 25,000 pounds. The maximum acceleration of the missile under these conditions will be 6 g's. It has been further discovered that, to the extent the acceleration of the missile is a limiting factor, the volume of chamber 14 should be as large as possible to achieve maximum ejection velocity. As a practical matter, of course, the maximum volume of the chamber is also limited by the quantity of air that can be supplied from accumulator 22.

Obviously many modifications and variations of the present invention are possible in the light of the above teachings. It is therefore to be understood that within the scope of the appended claims the invention may be practiced otherwise than as specifically described.

What is claimed is:

1. A missile launching system comprising a launching tube including a first chamber and a second chamber containing the missile to be launched, a source of gas compressed to a pressure substantially in excess of the pressure of the environment into which the missile is to be launched, and valve means for admitting said compressed gas into said first chamber a bulkhead between said first and second chambers, said bulkhead being formed with a plurality of openings, a plate formed with similar openings mounted for rotation on said bulkhead, and means for rotating said plate to gradually align the openings of the plate with the openings of the bulkhead during the launching movement of the missile in the launching tube to continually increase the flow of compressed gas from the first chamber to the second chamber causing a rapid rise of pressure in said first chamber and resultant constantly increasing pressure communicated to said second chamber via said adjustable orifice for launching said missile.

2. A missile launching system, according to claim 1, wherein the plate rotating means comprises annular gear teeth formed on said rotatable plate and a motor driven gear in mesh with said annular gear teeth to rotate said plate.

* * * * *